US005823616A

United States Patent [19]

Scott

[11] Patent Number: 5,823,616

[45] Date of Patent: Oct. 20, 1998

[54] FREE-STANDING BOOTH WITH TILTING TABLE

[75] Inventor: Stephen C. Scott, Warrenton, Mo.

[73] Assignee: Vitro Products, Inc., St. Louis, Mo.

[21] Appl. No.: 853,354

[22] Filed: May 8, 1997

[51] Int. Cl.[6] ..... A47B 83/02

[52] U.S. Cl. ..... 297/158.2; 108/48; 108/158.1

[58] Field of Search ..... 297/157.1, 158.1, 297/158.2, 170, 172, 173; 108/1, 44, 48

[56] References Cited

U.S. PATENT DOCUMENTS

| | | | |
|---|---|---|---|
| 1,073,762 | 9/1913 | Kade . | |
| 1,849,184 | 3/1932 | Gay | 108/48 |
| 1,903,954 | 4/1933 | Blumenthal . | |
| 1,928,508 | 9/1933 | Spang | 297/158.1 X |
| 2,144,083 | 1/1939 | Rentfrow, Sr. . | |
| 2,636,549 | 4/1953 | Gellen | 108/48 X |
| 3,105,448 | 10/1963 | Patrie . | |
| 3,636,892 | 1/1972 | Linton . | |
| 3,696,762 | 10/1972 | Holdham . | |
| 3,847,424 | 11/1974 | Nelson | 297/158.1 |
| 3,879,084 | 4/1975 | Jones . | |
| 4,036,150 | 7/1977 | Algier . | |
| 4,047,488 | 9/1977 | Gutridge et al. | 108/48 X |
| 5,369,898 | 12/1994 | Sorensen | 108/48 X |
| 5,452,936 | 9/1995 | Koehring | 297/158.1 X |
| 5,655,459 | 8/1997 | O'Conner et al. | 108/48 |

OTHER PUBLICATIONS

Berco, brochure entitled, "Series 80" (1993), 8 pages.
custom seating inc., catalogue insert entitled, "boothwork" (undated), 1 page.
custom seating inc., catalogue insert entitled, "specialty seating" (undated), 1 page.

*Primary Examiner*—Peter R. Brown
*Attorney, Agent, or Firm*—Senniger, Powers, Leavitt & Roedel

[57] ABSTRACT

A free-standing restaurant booth including a pair of spaced apart opposing benches for providing seating to patrons of a restaurant. Each of the benches has a pedestal for placement on a floor of the restaurant, a seat mounted on the pedestal and a back extending up from the seat. The booth further includes a table support spaced above the floor. The support includes a base extending between and connecting the pedestals of the pair of opposing benches and a horizontal frame connected to the base. In addition, the booth includes a table top pivotally mounted on the support frame for movement between a substantially level position in which the top is supported by the frame for setting articles thereon and a tilted position for permitting access to the seats and the floor under the table top.

20 Claims, 10 Drawing Sheets

26'
20'
90'
92'
50'
22b'
94'
54'
96'
34b'
46'
98'
44'
32c'
24'
82'
40'
72'
42'
F
30b'

FREE-STANDING BOOTH WITH TILTING TABLE

BACKGROUND OF THE INVENTION

This invention relates generally to a booth for use in restaurants and in particular to a booth having a tilting table top for permitting access to seats and the floor under the table top.

A conventional restaurant booth comprises a pair of opposing seats and a table having a stationary top. Dirt and debris collect on the floor and seats under the table top. Because the stationary table top obstructs the floor and seats, it is difficult for restaurant employees to clean these surfaces. If the tables are free-standing, the tables may be moved to permit access to the floor and seats. However, because free-standing tables tip easily, table tops having fixed supports are preferred.

Fixed table top supports have several different configurations. For instance, some fixed supports mount on a wall adjacent the booth so the table top is cantilevered from the wall. This configuration generates large loads on the wall. As a result, the wall must be reinforced to prevent failure. In addition, dirt which collects between the table top and the wall is difficult to remove. Still further, additional walls must be positioned throughout the restaurant to support table tops. To reduce the construction cost and the opportunity for dirt to collect along the edge of the table top, other types of fixed supports are frequently used.

Among these other types of fixed supports are supports which are rigidly mounted on the floor or attached between the seats. Although these supports eliminate tipping and reduce construction costs, they obstruct access to the floor beneath the table tops. Moreover, dirt collects around the bases of floor-mounted table supports and is difficult to remove. Still further, the fixed supports make the table immoveable thereby inhibiting some persons, particularly the elderly and handicapped, from entering and exiting the booth.

SUMMARY OF THE INVENTION

Among the several objects and features of the present invention may be noted the provision of a free-standing booth having a pivotable table top for enabling access to the seats and the floor under the table top; the provision of such a booth wherein the spacing between opposing benches is adjustable; the provision of such a booth having no metal parts in contact with the floor; and the provision of such a booth having a configuration for preventing the collection of debris between the table support and the floor or wall of the restaurant.

Briefly, apparatus of this invention is a free-standing restaurant booth comprising a pair of spaced apart opposing benches for providing seating to patrons of a restaurant. Each of the benches has a pedestal for placement on a floor of the restaurant, a seat mounted on the pedestal and a back extending up from the seat. The booth further comprises a table support spaced above the floor. The support comprises a base extending between and connecting the pedestals of the pair of opposing benches and a horizontal frame connected to the base. In addition, the booth comprises a table top pivotally mounted on the support frame for movement between a substantially level position in which the top is supported by the frame for setting articles thereon and a tilted position for permitting access to the seats and the floor under the table top.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
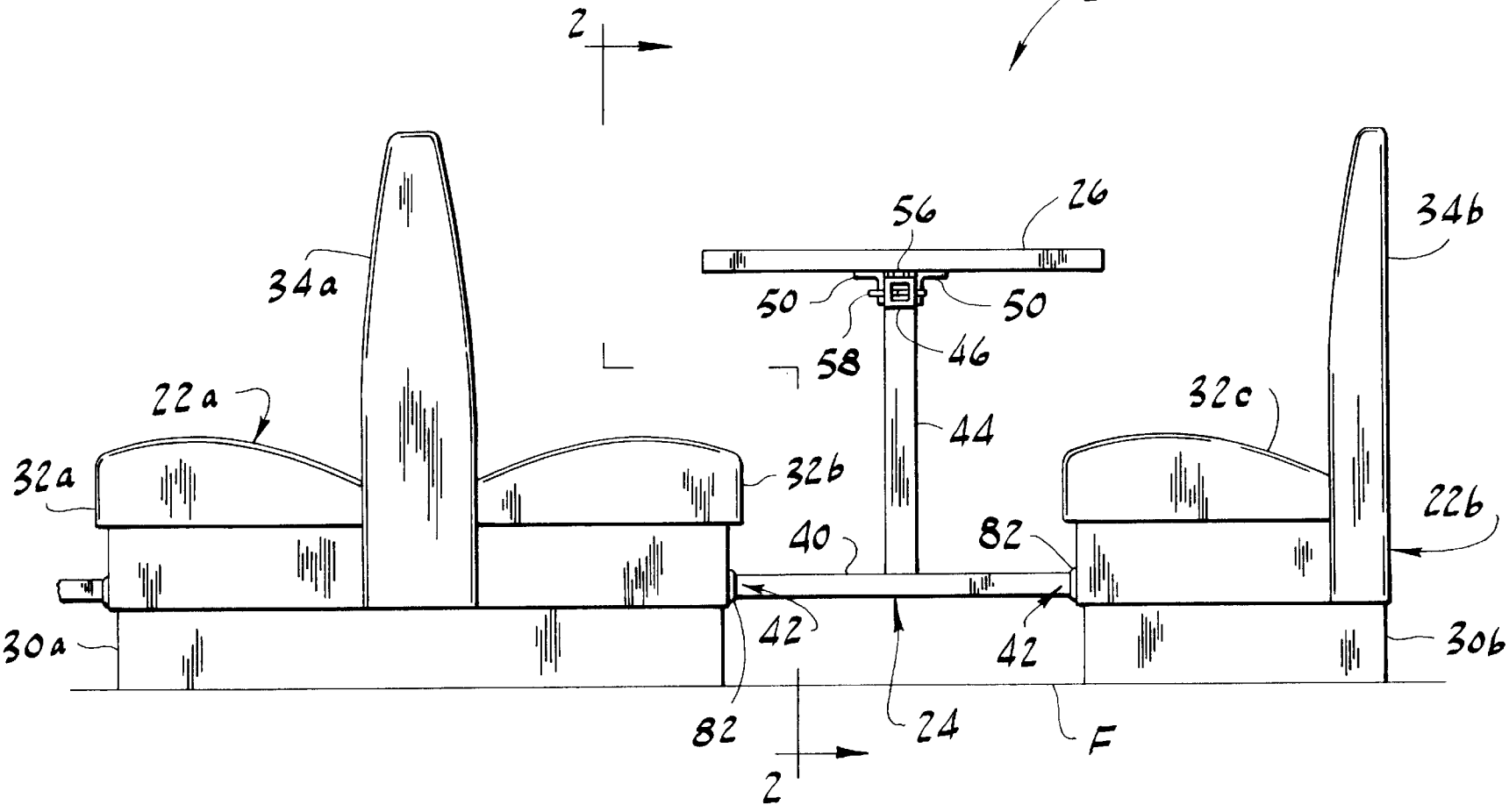
FIG. 1 is a front elevation of a first embodiment of a booth of the present invention showing a single and a double bench in combination with a tilting table top.
Figure 2:
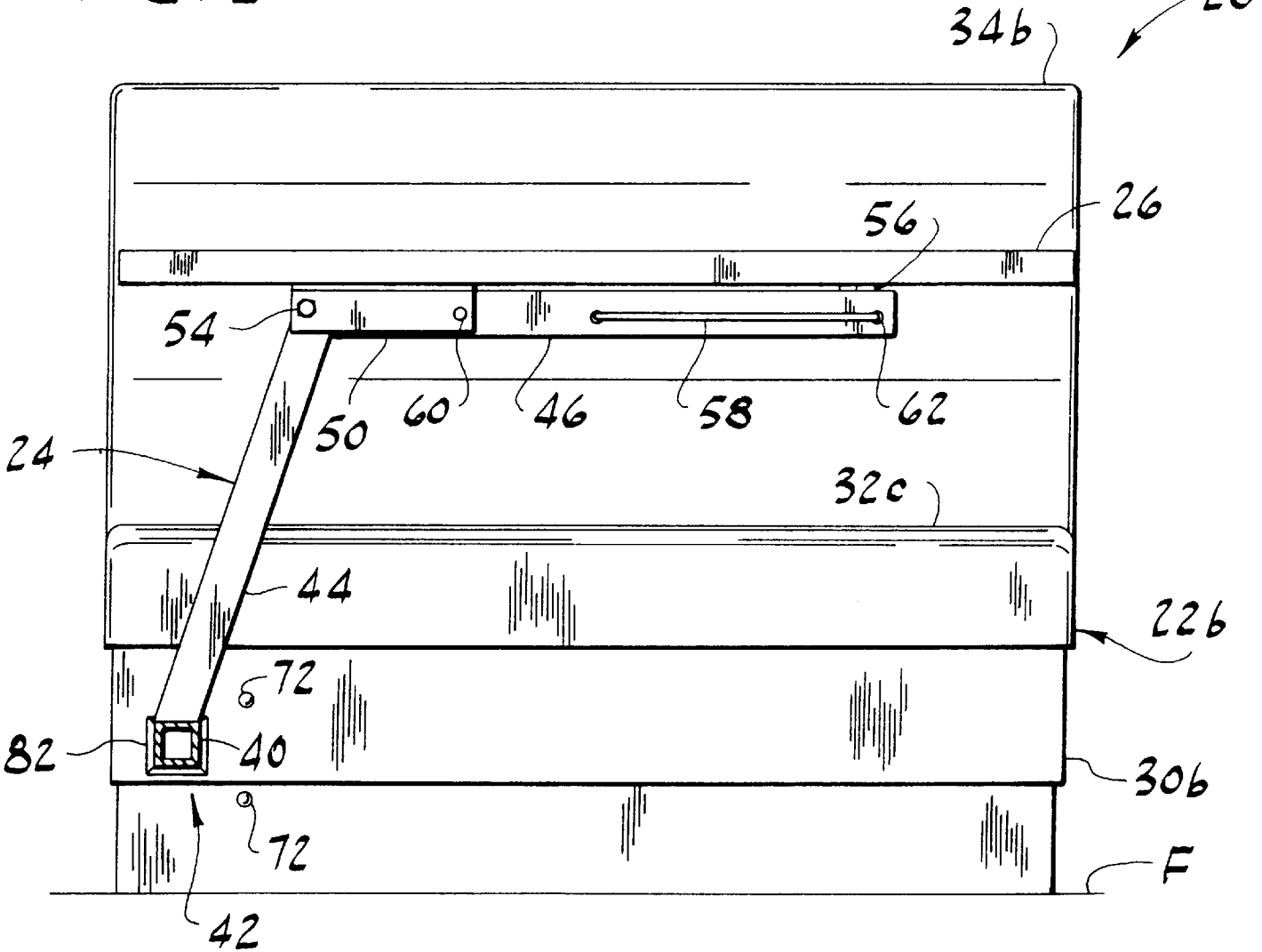
FIG. 2 is a cross section of the booth taken along line 2—2 of FIG. 1.

Referring now to the drawings and in particular to FIGS. 1 and 2, a first embodiment of a free-standing restaurant booth of the present invention is designated in its entirety by the reference numeral 20, and generally comprises a pair of benches (generally designated 22*a*, 22*b*), a table support (generally designated 24) and a table top 26. Although other combinations are envisioned as being within the scope of the present invention, the benches 22*a*, 22*b* shown in FIGS. 1 and 2 are a double bench and a single bench, respectively. The double bench 22*a* has a pedestal 30*a*, two padded seats 32*a*, 32*b* facing in opposite directions and a padded back 34*a* positioned between the seats. The single bench 22*b* has a pedestal 30*b*, a padded seat 32*c* facing the second seat 32*b* of the double bench 22*a* and a padded back 34*b* positioned at the rear of the seat. The pedestals 30*a*, 30*b* rest directly on a floor F of the restaurant, and may be attached to the floor if desired. The height, depth and length of the pedestals 30*a*, 30*b* vary depending upon whether the bench is a single or double bench, as well as upon the desired length of the booth. The pedestals 30*a*, 30*b* shown in FIGS. 1 and 2 are of a conventional, two tiered, wood panel construction. However, other configurations and materials are envisioned as being within the scope of the present invention. For example, it is envisioned that an alternate configuration may include steel tubes attached directly to the restaurant floor. As the construction of the benches is conventional, it will not be explained in further detail.

The table support 24 extends between the benches above the floor. The support 24 comprises a tubular base 40 which is received by sockets (each generally designated 42) in the benches 22*a*, 22*b* as will be explained in greater detail below. The support 24 connects the pedestals 30*a*, 30*b* of the pair of opposing benches 22*a*, 22*b* to maintain the benches in a fixed but adjustable spacing. As illustrated in FIG. 2, a tubular support member 44 extends upward at an angle from the base 40 and a cantilevered tubular frame 46 extends horizontally from the upper end of the support member for supporting the table top 26. Although other materials may be used without departing from the scope of the present invention, the support 24 of the preferred embodiment is made from two inch square, steel tubing having a 0.250 inch wall thickness. Several methods may be used to rigidly connect the base 40, support member 44 and frame 46 to each other without departing from the scope of the present invention. For instance, these components may be welded together.

Figure 3:
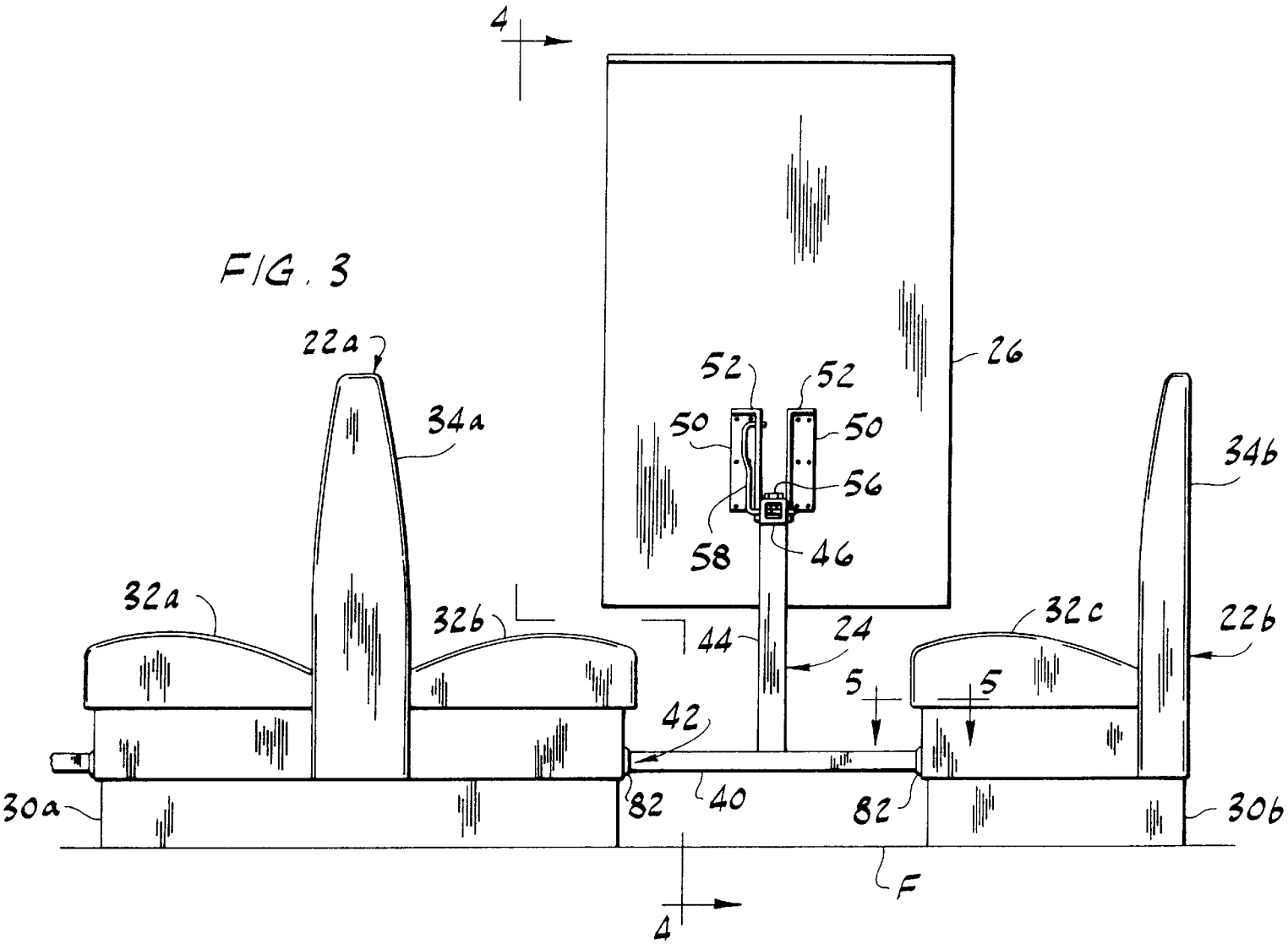
FIG. 3 is a front elevation of the booth shown with the table top tilted.
Figure 4:
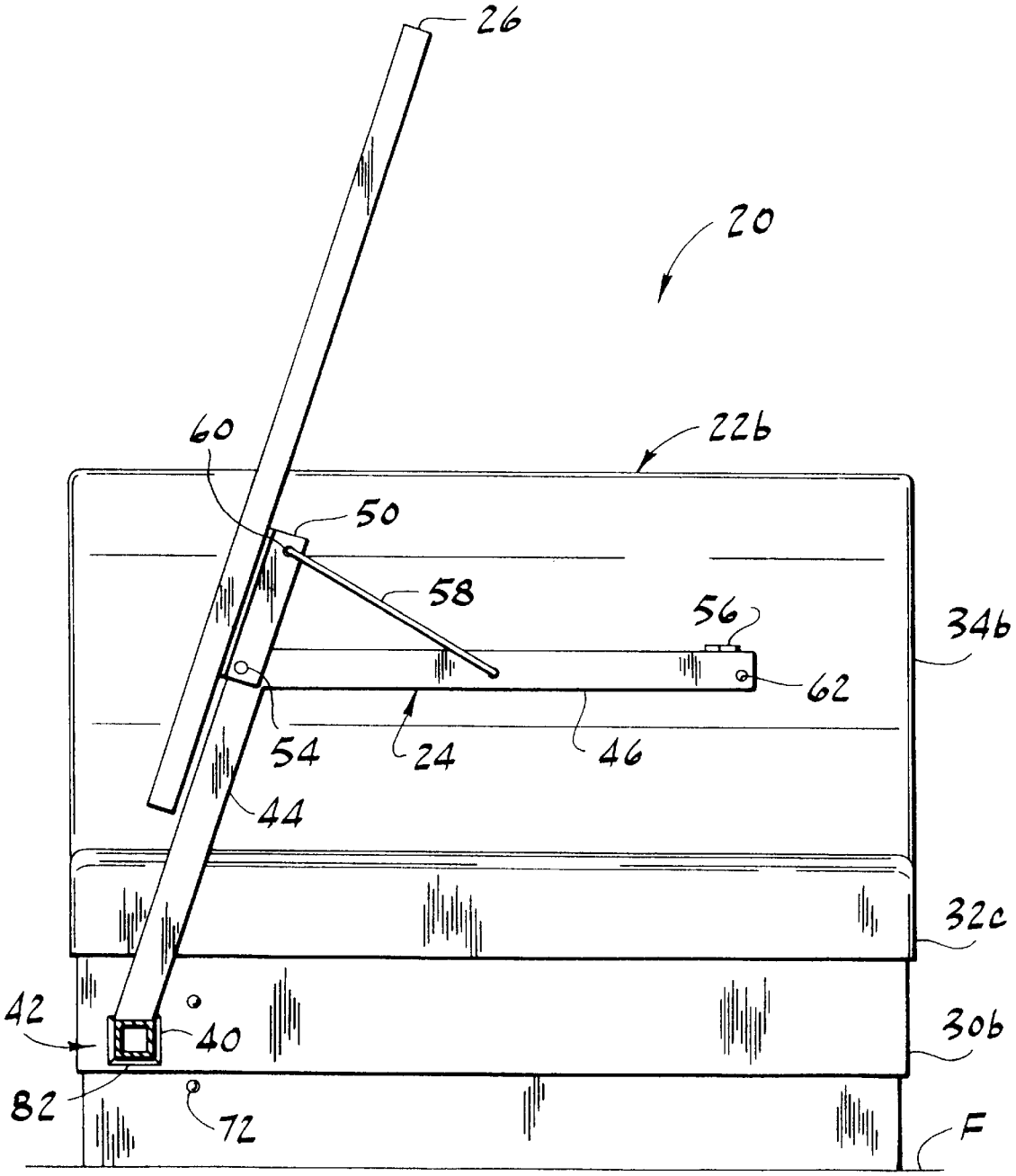
FIG. 4 is a cross section of the booth taken along line 4—4 of FIG. 3.

The table top 26 is pivotally mounted on the support frame 46 for movement between a substantially level position in which the top is supported by the frame as shown in FIGS. 1 and 2 and a tilted position as shown in FIGS. 3 and 4. As illustrated in FIG. 3, angle brackets 50, attached to the lower surface of the table top 26 with screw fasteners 52 (FIG. 2), extend down from the table top on each side of the horizontal frame 46. A hinge pin or bolt 54 (FIG. 2) extends through holes (not shown) in the brackets 50 and the frame 46 to pivotally connect the table top 26 to the frame 46 to permit the top to rotate between the level and tilted positions. A leveling screw 56 is screwed into a threaded hole (not shown) in the top of the horizontal frame 46 for supporting the table top 26 in a level position. This screw 56 may be adjusted to level the table top 26. A brace 58 is pivotably connected to the horizontal frame 46. As illustrated in FIG. 4, the brace 58 engages a hole 60 in one of the brackets 50 for supporting the table top 26 when it is in the tilted position. As illustrated in FIG. 2, a hole 62 in the frame 46 receives the brace 58 for storage when the table top 26 is in its level position. As further illustrated in FIG. 2, the brace 58 is bent so a portion of the brace is spaced from the frame 46 thereby making it is easy to grasp.

As will be apparent to those skilled in the art, the table top 26 is counter-balanced because the bolt 54 is positioned intermediate the ends of the table. Thus, the table top 26 is easier to lift than it might otherwise be. However, because the top is not entirely balanced, the top is unlikely to be unintentionally raised if a patron pushes down on the top directly over the base 40. Further, when the booth 20 is positioned against a wall, the table top 26 does not move substantially closer to the wall as the top is lifted because the bolt 54 is spaced from the end of the table top 26. Consequently, the table top 26 does not contact the wall and mar it as the top is lifted. Moreover, the hinge position causes the edge of the table top 26 to move away from the wall when the top is lifted. This permits access to both the wall and the edge of the table so they may be cleaned easily.

Figure 5:
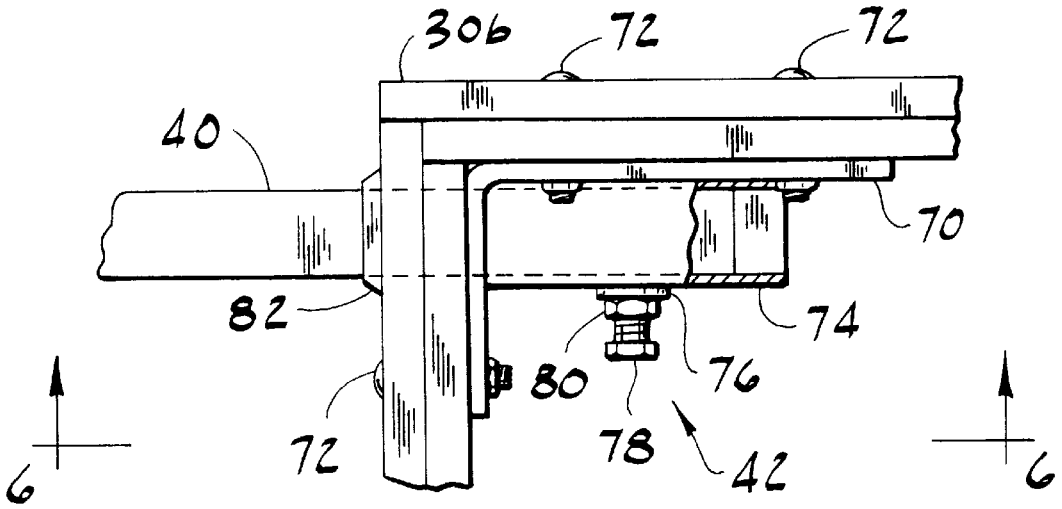
FIG. 5 is a fragmentary plan view of the booth taken in the plane of line 5—5 of FIG. 3 shown with the bench seat removed.
Figure 6:
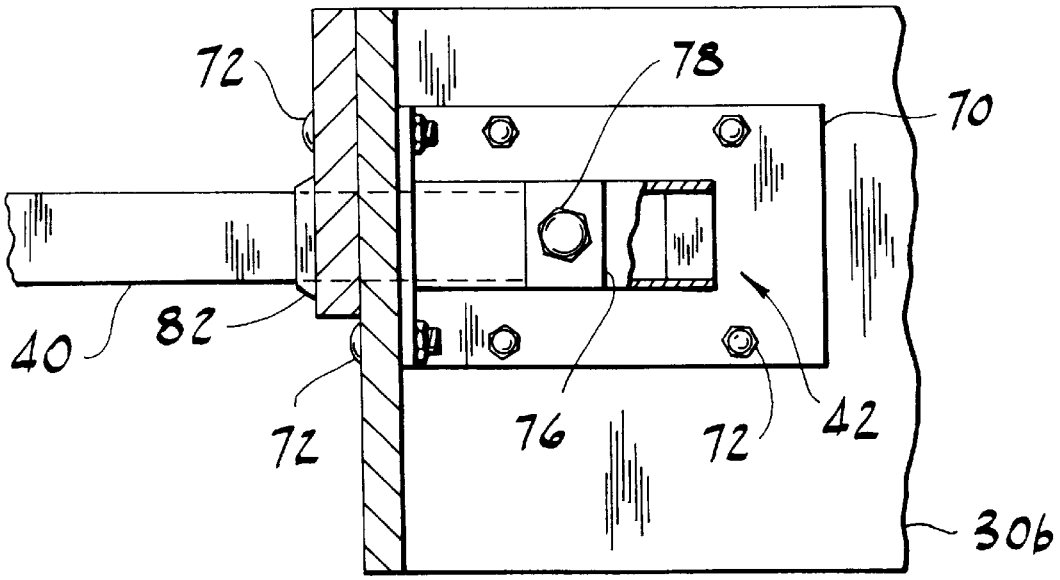
FIG. 6 is a fragmentary cross section of the bench taken in the plane of line 6—6 of FIG. 5.
Figure 7:
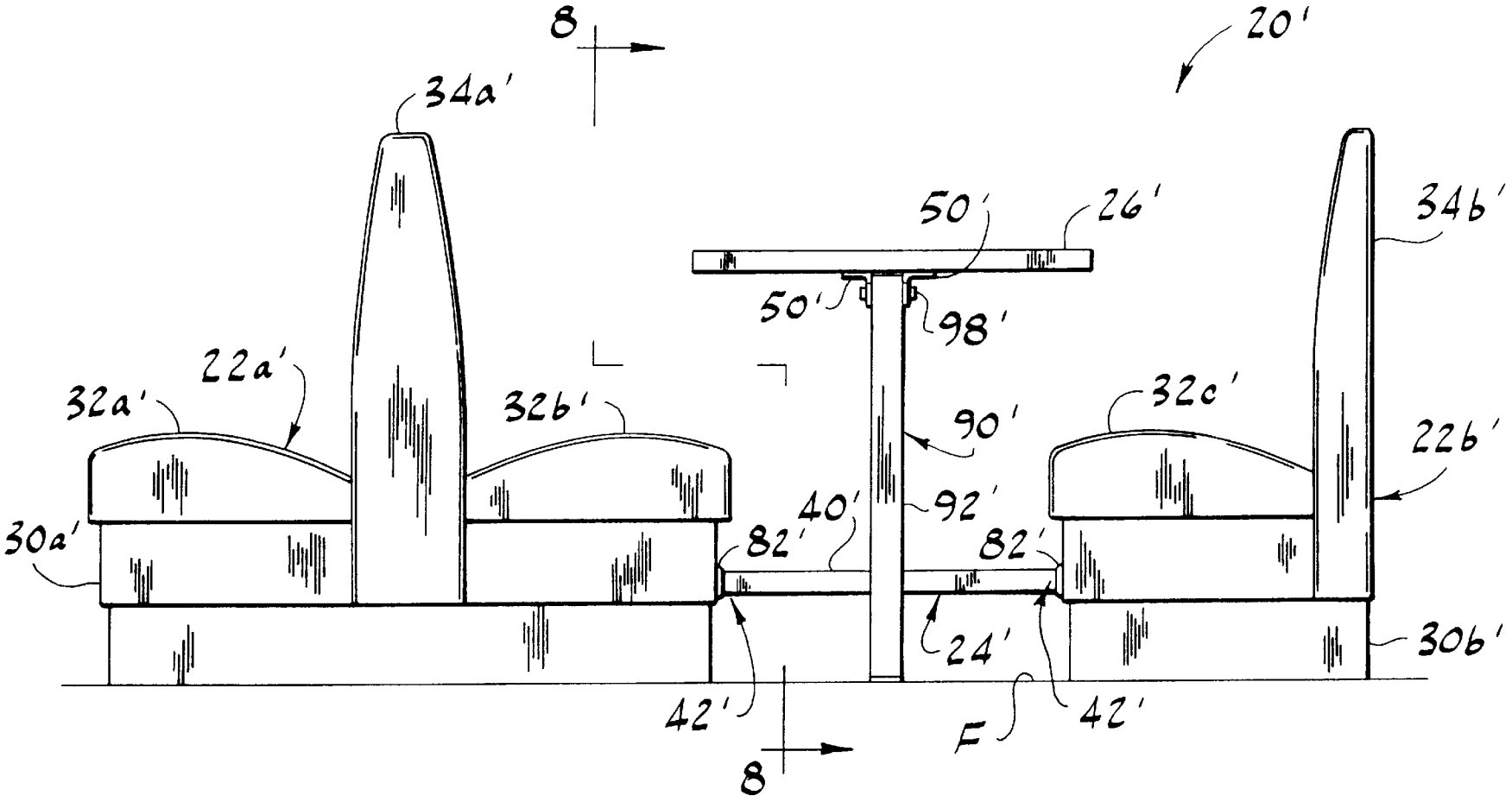
FIG. 7 is a front elevation of a second embodiment of the booth of the present invention.
Figure 8:
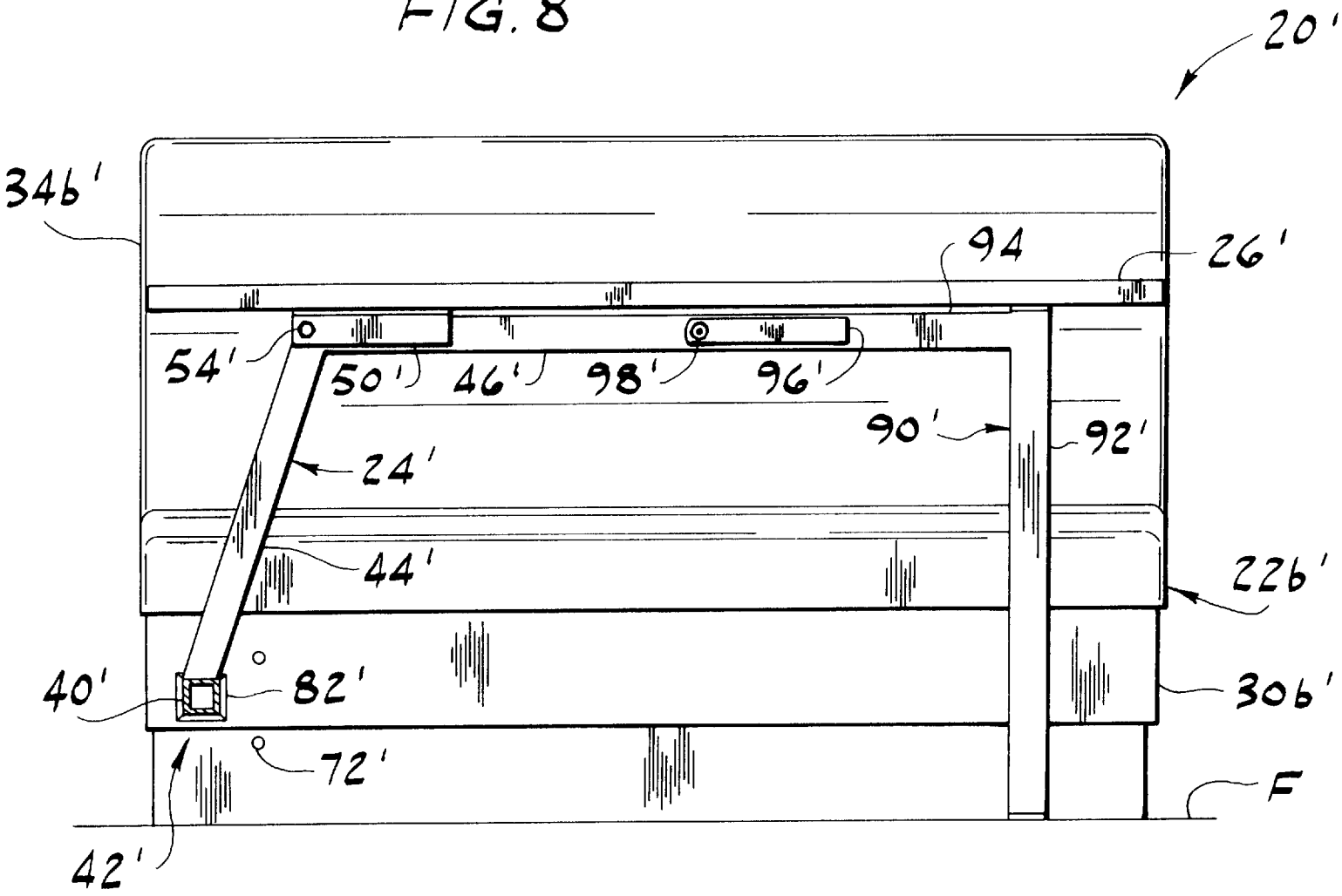
FIG. 8 is a cross section of the booth of the second embodiment taken along line 8—8 of FIG. 7.

As further shown in FIGS. 5 and 6, an angled plate 70 is fastened with screw fasteners 72 to an interior corner of each pedestal 30*a*, 30*b*. A square tube 74 is welded to each plate 70 to form the sockets 42 for receiving ends of the support base 40 to connect the table support 24 to the benches 22*a*, 22*b*. Square holes (not shown) extending through the pedestals 30*a*, 30*b* and plates 70 permit the base 40 to pass into the respective benches 22*a*, 22*b*. A threaded plate 76 is welded over a hole (not shown) in each tube 74 for receiving a set screw or locking bolt 78 which releasably engages the base 40 for adjustably attaching the support 24 to the respective bench 22*a*, 22*b*. A jam nut 80 threaded on each bolt 78 may be tightened against the respective plate 76 to prevent the bolt from loosening. An escutcheon 82 positioned around the support base 40 covers the interface between the support 24 and the respective bench 22*a*, 22*b*.

As will be apparent to those skilled in the art, the socket 42 described above is configured to receive an end of the table support 24 to a plurality of depths. Thus, the spacing between the opposing benches 22*a*, 22*b* is adjustable. Further, when several booths are fastened together as one assembly, the overall length of the assembly may be infinitely adjusted within a range of standard lengths to compensate for different room sizes. Although other materials may be used without departing from the scope of the present invention, the tube 74 of the preferred embodiment is made from 2¼ inch square, steel tubing having a 0.078 inch wall thickness. As will be apparent to those skilled in the art, the benches 22*a*, 22*b* are positioned so the base 40 is adjacent an end of the bench opposite an aisle of the restaurant. Thus, the base 40 does not interfere with patrons when entering and exiting the booth 20.

Figure 9:
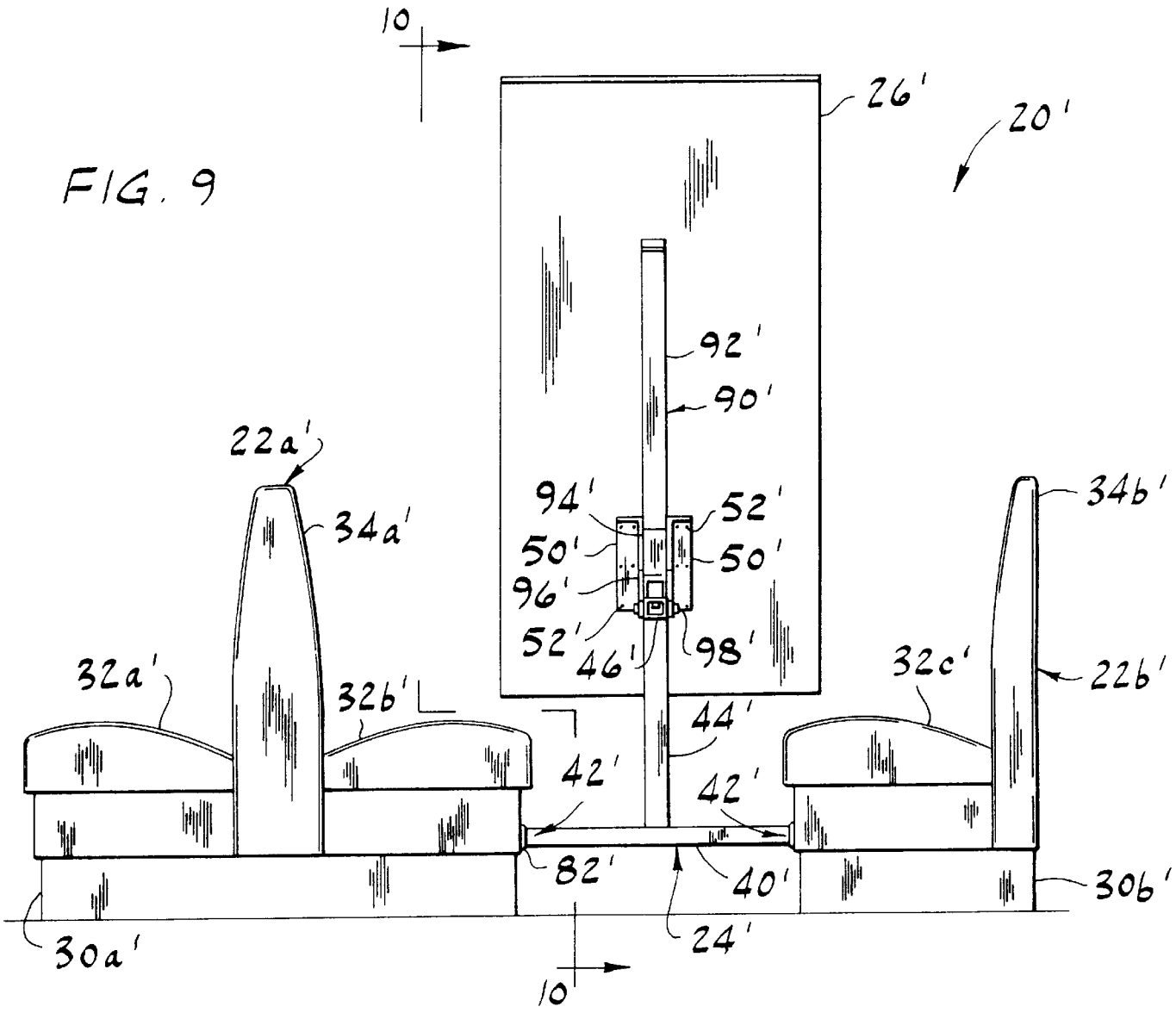
FIG. 9 is a front elevation of the booth of the second embodiment shown with the table top tilted.
Figure 10:
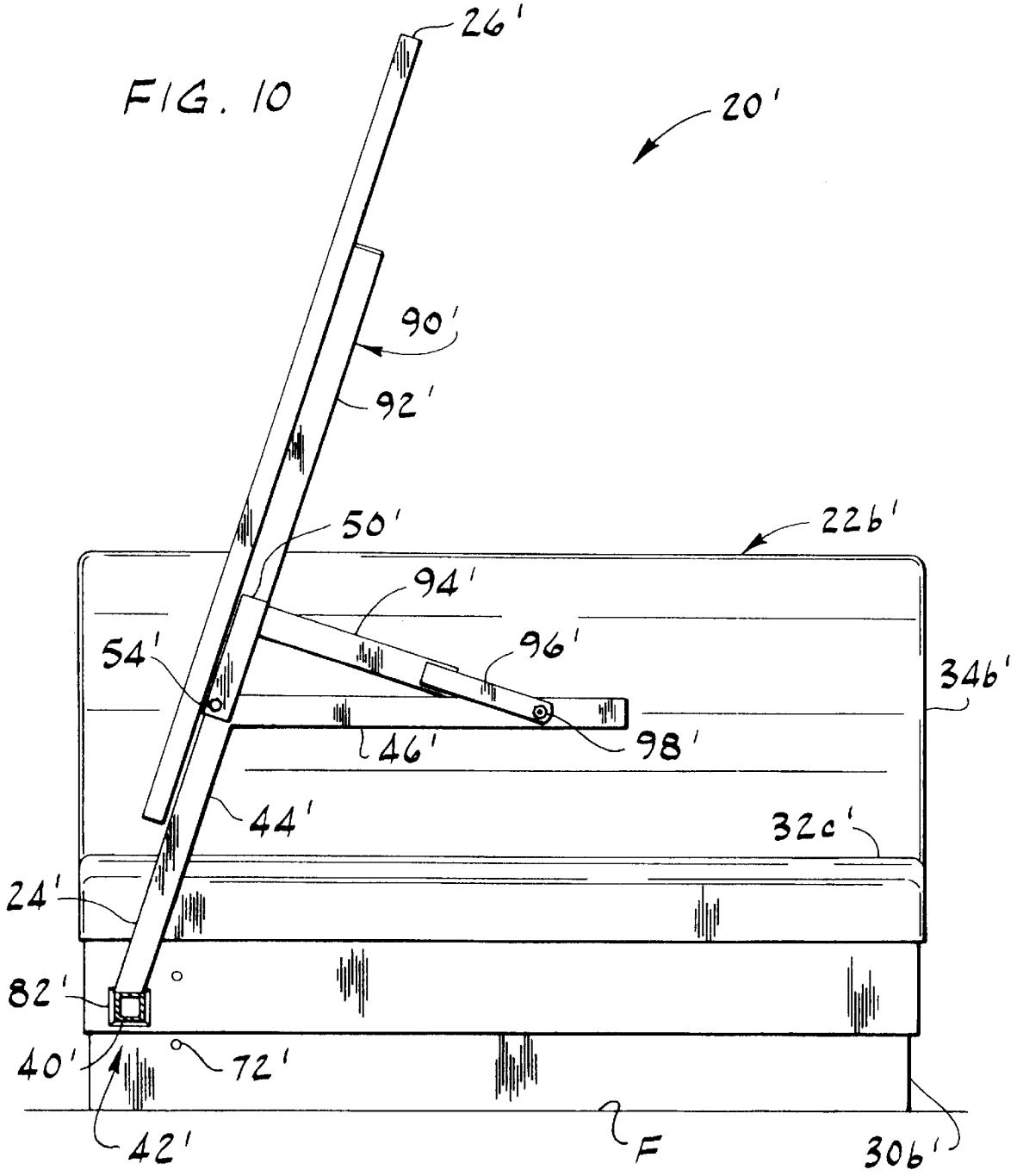
FIG. 10 is a cross section of the booth taken along line 10—10 of FIG. 9.
Figure 11:
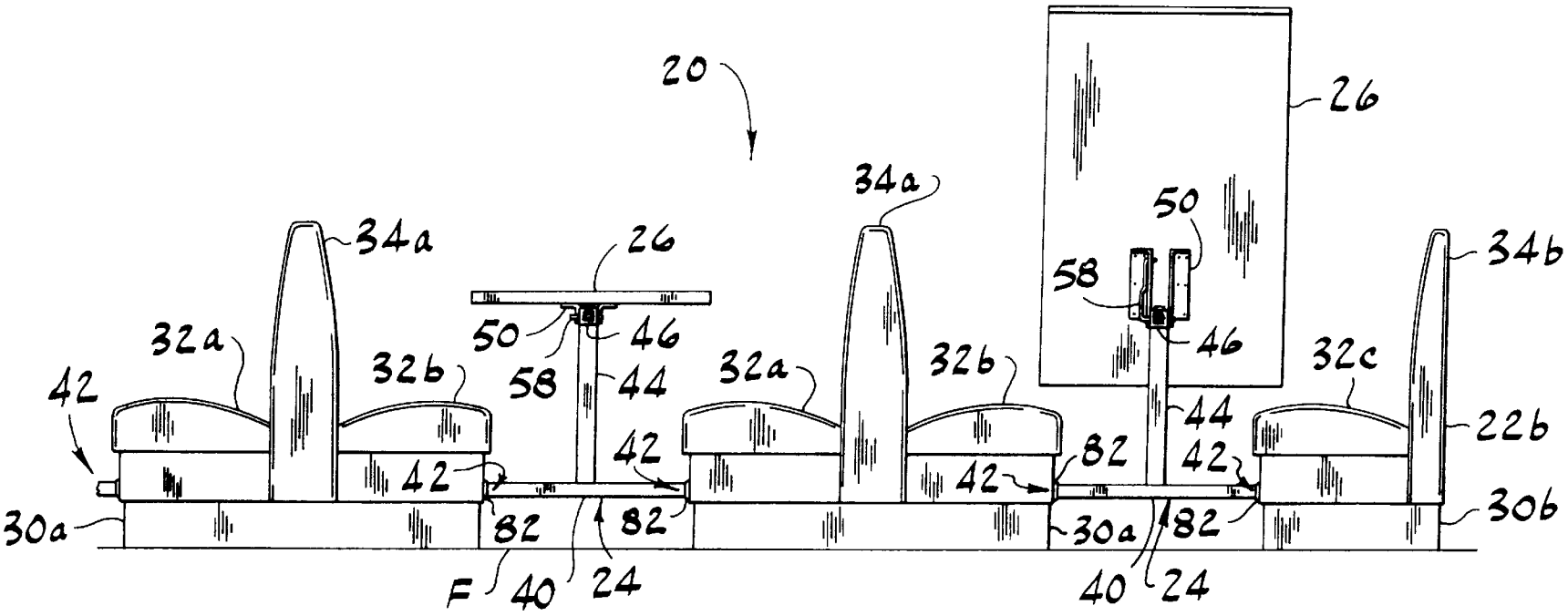
FIG. 11 is a front elevation of the first embodiment of the booth of the present invention showing a single and two double benches in combination with tilting table tops.

A second embodiment of the booth 20' of the present invention is illustrated in FIGS. 7–10. The booth 20' of the second embodiment is identical in all respects to the booth 20 of the first embodiment except that the brace 58 of the first embodiment is replaced with an L-shaped member, generally designated 90', comprising an upright 92' and a spacer 94'. Although other materials may be used without departing from the scope of the present invention, the leg 90' of the preferred embodiment is made from welded sections of two inch square, steel tubing having a 0.064 inch wall thickness. A plate 96' is welded to each side of the spacer 94' and a hinge pin or bolt 98' extends through holes (not shown) in the support frame 46' and plates so the leg 90' may be pivoted upward about the hinge bolt as illustrated in FIGS. 9 and 10 to support the table top 26 when in the tilted position. The leveling screw 56 is also omitted from the second embodiment.

As will be apparent to those skilled in the art, the shape of the leg 90' has several advantages. First, the spacer 94' positions the upright 92' closer to the end of the table top 26' opposite the hinge bolt 98' when the top is in the level position (FIGS. 7 and 8) to better support the table top. Second, the spacer 94' extends between the hinge bolt 98' and the table top 26' when in the tilted position (FIGS. 9 and 10) to rigidly brace the table top. Third, the upright 92' extends upward under the table top 26' when in the tilted position to better support the table top and to positively locate the spacer 94' in a bracing position. Because of these advantages, the second embodiment is particularly suited for use with longer table tops. For instance, the first embodiment may be used for four person booths having 48 inch long table tops, and the second embodiment may be used for six-person booths having 60 inch long table tops.

Both of the previously described embodiments provide free-standing booths which do not require the walls of the restaurant to be reinforced and which do not collect dirt between the booth and restaurant walls. Further, both embodiments have pivotable table tops which enable persons to easily enter and exit the seats and to access the floor under the table top for cleaning. Because the table supports 24, 24' are spaced above the floor F, water and corrosive cleaning agents are less likely to come in contact with them.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A free-standing restaurant booth capable of use remote from and without attachment to a supporting wall of a restaurant comprising:

a pair of spaced apart opposing benches for providing seating to patrons of the restaurant, each of said benches having a pedestal for placement on a floor of the restaurant, a seat mounted on the pedestal and a back extending up from the seat;

a table support spaced above the floor comprising a base extending between and connecting the pedestals of said pair of opposing benches and a horizontally extending support frame rigidly connected to the base; and a table top pivotally mounted on the support frame for movement between a substantially level position in which the top is supported by the frame for setting articles thereon and a tilted position for permitting access to the seats and the floor under the table top.

2. A booth as set forth in claim 1 further comprising a pivotable brace connected to at least one of the table top and the table support for supporting the table top when in said tilted position.

3. A booth as set forth in claim 2 wherein said pivotable brace includes a leg which extends down to the floor when the table top is in said level position for supporting the table top.

4. A booth as set forth in claim 1 wherein the table top has opposite ends and pivots about a centerline located intermediate the ends of the table top when the top is moved between said level and tilted positions.

5. A booth as set forth in claim 1 wherein each of the pedestals of the opposing benches has a socket for receiving the table support to connect the support to the respective pedestal.

6. A booth as set forth in claim 5 wherein each socket includes a screw fastener for releasably fastening the table support to the pedestal.

7. A booth as set forth in claim 6 wherein each socket is adapted to receive an end of the table support to a plurality of depths to thereby adjust the spacing between the opposing benches.

8. A booth as set forth in claim 7 wherein each screw fastener is adapted for releasably fastening the table support to a respective pedestal when the respective end of the support is received by the respective socket to any one of said plurality of depths.

9. A booth as set forth in claim 1 wherein said pair of benches comprises first and second benches and said first bench is a double bench having opposite sides for seating patrons facing opposite directions.

10. A booth as set forth in claim 9 wherein said table support is a first table support, said table top is a first table top, and said booth further comprises:

a third bench spaced apart from said first bench on a side of said first bench opposite said second bench, said third bench having a pedestal for placement on the floor of the restaurant, a seat mounted on the pedestal and a back extending up from the seat;

a second table support spaced above the floor comprising a base extending between and connecting the pedestals of said first and third benches and a horizontally extending support frame connected to the base; and a second table top pivotally mounted on the frame of said second support for movement between a substantially level position in which said second top is supported by the frame of said second support for setting articles thereon and a tilted position for permitting access to the seats and the floor under said second table top.

11. A free-standing restaurant booth capable of use remote from and without attachment to a supporting wall of a restaurant comprising:

a pair of spaced apart opposing benches for providing seating to patrons of the restaurant, each of said benches having a pedestal for placement on a floor of the restaurant, a seat mounted on the pedestal and a back extending up from the seat;

a table support spaced above the floor comprising a base extending between and connecting the pedestals of said pair of opposing benches, a support member extending generally upward from the base to an upper end positioned approximately midway between said benches and a support frame rigidly mounted to and extending horizontally from the upper end of the support member along a line generally midway between said benches; and a table top pivotally mounted on the support frame for movement between a substantially level position in which the top is supported by the frame for setting articles thereon and a tilted position for permitting access to the seats and the floor under the table top.

12. A booth as set forth in claim 11 further comprising a pivotable brace connected to at least one of said table top and said table support for supporting the table top when in said tilted position.

13. A booth as set forth in claim 12 wherein said pivotable brace includes a leg which extends down to the floor when the table top is in said level position for supporting the table top.

14. A booth as set forth in claim 11 wherein the table top has opposite ends and pivots about a centerline located intermediate the ends of the table top when the top is moved between said level and tilted positions.

15. A booth as set forth in claim 11 wherein each of the pedestals of the opposing benches has a socket for receiving the base of the table support to connect the support to the respective pedestal.

16. A booth as set forth in claim 15 wherein each socket includes a screw fastener for releasably fastening the base of the table support to the pedestal.

17. A booth as set forth in claim 16 wherein each socket is adapted to receive an end of the base to a plurality of depths to thereby adjust the spacing between the opposing benches.

18. A booth as set forth in claim 17 wherein each screw fastener is adapted for releasably fastening the base to a respective pedestal when the respective end of the base is received by the respective socket to any one of said plurality of depths.

19. A booth as set forth in claim 11 wherein said pair of benches comprises first and second benches and said first bench is a double bench having opposite sides for seating patrons facing opposite directions.

20. A booth as set forth in claim 19 wherein said table support is a first table support, said table top is a first table top, and said booth further comprises:

a third bench spaced apart from said first bench on a side of said first bench opposite said second bench, said third bench having a pedestal for placement on the floor of the restaurant, a seat mounted on the pedestal and a back extending up from the seat;

a second table support spaced above the floor comprising a base extending between and connecting the pedestals of said first and third benches, a support member extending generally upward from the base to an upper end positioned approximately midway between said first and third benches and a support frame extending horizontally from the upper end of the support member along a line generally midway between said first and third benches; and a second table top pivotally mounted on the frame of said second support for movement between a substantially level position in which said second top is supported by the frame of said second support for setting articles thereon and a tilted position for permitting access to the seats and the floor under said second table top.

* * * * *